US006516638B1

(12) United States Patent
Myerscough

(10) Patent No.: US 6,516,638 B1
(45) Date of Patent: Feb. 11, 2003

(54) WASHING MACHINE

(75) Inventor: Martin William Myerscough, Woodbridge (GB)

(73) Assignee: Monotub PLC (GB)

( * ) Notice: Subject to any disclaimer, the term of this patent is extended or adjusted under 35 U.S.C. 154(b) by 98 days.

(21) Appl. No.: 09/611,689

(22) Filed: Jul. 7, 2000

Related U.S. Application Data

(63) Continuation of application No. PCT/GB99/00027, filed on Jan. 6, 1999.

(30) Foreign Application Priority Data

Jan. 9, 1998 (GB) ..... 9800494

(51) Int. Cl.[7] ..... D06F 37/20

(52) U.S. Cl. ..... 68/23.1; 68/23.2; 68/24; 248/562; 248/638

(58) Field of Search ..... 68/23, 23.1, 23.2, 68/23.3, 24, 140, 25, 58; 248/562, 571, 614, 638; 366/220, 232

(56) References Cited

U.S. PATENT DOCUMENTS

| | | | | |
|---|---|---|---|---|
| 2,296,259 | A | * | 9/1942 | Breckenridge |
| 2,397,268 | A | | 3/1946 | Jorgenson et al. |
| 2,615,320 | A | * | 10/1952 | Belaieff |
| 2,645,548 | A | | 7/1953 | Kreitchman et al. |
| 2,899,816 | A | | 8/1959 | Jacobsen, Jr. |
| 2,950,906 | A | * | 8/1960 | Hilkemeier |
| 3,275,152 | A | * | 9/1966 | Searle |
| 3,570,273 | A | * | 3/1971 | Hertig |
| 3,666,240 | A | * | 5/1972 | Lodige et al. |
| 3,682,398 | A | * | 8/1972 | Lamort |
| 3,945,226 | A | * | 3/1976 | De Hedouville |
| 4,080,165 | A | * | 3/1978 | Thompson |
| 4,114,406 | A | * | 9/1978 | Horowitz et al. |
| 4,835,993 | A | * | 6/1989 | Dreher |
| 4,836,099 | A | * | 6/1989 | Thirode |
| 5,327,603 | A | * | 7/1994 | Roh et al. |
| 6,000,248 | A | * | 12/1999 | Erickson et al. |
| 6,092,400 | A | * | 7/2000 | Sumner et al. |

FOREIGN PATENT DOCUMENTS

| | | | |
|---|---|---|---|
| CA | 492968 | * | 5/1953 |
| DE | 1136974 | * | 9/1962 |
| DE | 3143140 | * | 5/1983 |
| DE | 4202760 | * | 8/1983 |
| DE | 3546133 | * | 7/1987 |
| DE | 42 02 760 A | | 8/1993 |
| FR | 1230710 | * | 9/1960 |
| FR | 263742 | * | 4/1988 |
| JP | 4-371193 | * | 12/1992 |
| JP | 5-84386 | * | 4/1993 |
| WO | WO 99/54539 | * | 10/1999 |

* cited by examiner

*Primary Examiner*—Frankie L. Stinson
(74) *Attorney, Agent, or Firm*—Fredrikson & Byron, P.A.

(57) ABSTRACT

Washing machine having a drum (4) inclined to the horizontal and supported by a suspension system including a first, lenear suspension unit (1, 2) inclined at an angle substantially normal to the axis of the drum (4), and a second suspension unit (3) generally parallel to the axis of the drum (4).

16 Claims, 2 Drawing Sheets

WASHING MACHINE

CROSS-REFERENCE TO RELATED APPLICATIONS

The present application is a continuation of International Application No. PCT/GB99/00027, filed Jan. 6, 1999, which derives priority from British Application No. GB 9800494.8 filed Jan. 9, 1998, the teachings of which are incorporated herein by reference.

FIELD OF THE INVENTION

The present invention relates to a washing machine, and in particular to a washing machine having a drum mounted on an inclined axis, and more particularly to a suspension system used in such a machine.

PRIOR ART

Washing machines are known which include a drum rotatably mounted about a horizontal axis in a fixed water tank. The water tank is supported by a number of suspension units which are vertically mounted inside the washing machine. It is common for each of the suspension units to comprise a cylindrical body portion including an annular damper and a support rod slidably provided in the body and spring biased away from the body. The cylindrical body is fixed to the casing of the washing machine, typically using rubber washers, and the support rod is fixed to the water tank. Such a suspension system supports both the static load due to the weight of the drum, water tank, water contained in the water tank and the clothes contained in the drum, and the dynamic load when the drum is rotated, since these loads are in a generally vertical plane perpendicular to the axis of rotation of the drum. The suspension system has limited resistance to forces generally parallel to the axis of rotation of the drum, however in use there are little if any such components of force.

It has been proposed to provide a washing machine with a drum which has an axis of rotation inclined to the horizontal. One such commercially available machine is the "NEPTUNE" available from Maytag. In this machine, vertical suspension units are used in conventional washing machines are provided to support the lower rear end of the water tank, and springs connected between the top of the machine casing and the upper front end of the water tank. This combination of suspension units supports the vertical components of the static and dynamic loads, but are unable to completely prevent the forwards and backwards movement of the tank, especially during high speed rotation of the drum, for example during spinning. This means that it is necessary to have a large gap between the water tank and the washing machine cabinet to ensure that there is no contact between these parts during operation of the washing machine.

It has not been considered possible to incline the suspension units so that these lie normal to the axis of rotation of the drum since there will be a component of the static load perpendicular to the suspension unit which will cause the support rod to band or twist with respect to the cylinder. This may prevent the correct functioning of the suspension unit and cause the damper to wear rapidly.

SUMMARY OF THE INVENTION

According to the present invention, a washing machine comprises a drum mounted for rotation about an inclined axis, a first, linear, suspension unit inclined at an angle substantially normal to the axis of rotation of the drum, and a second suspension unit provided generally parallel to the axis of the rotation of the drum.

With this arrangement, the first, linear, suspension unit is at the same angle as the main dynamic load as the drum is rotated. The dynamic load is typically much higher than the static load, typically 300 kgf as opposed to a vertical static load of 60 kgf, and therefore the first, linear, suspension unit is able to support the drum against the largest forces. The second suspension unit is able to balance the component of static force normal to that supported by the first suspension unit, and is therefore able to balance the component of force which otherwise would tend to bend or twist the first suspension unit. Accordingly, the combination of the two suspension units balances the main static and dynamic loads in the washing machine, and prolongs the life of the suspension units.

This arrangement results in very little front to back, movement of the drum and allows the drum to be located in a cabinet with a very small gap between the drum and the cabinet, and therefore allows a larger drum than normal to be provided in a standard sized cabinet.

The first, linear, suspension unit preferably comprises a body portion which slidably supports a rod which is biased away from the body. In this case, a force on the rod tends to move the rod into the body, and this movement is opposed by the bias of the rod away from the body to give the required suspension effect. Such a suspension unit gives little resilience to forces in a direction transverse to the rod. In this case, the first suspension unit preferably includes an annular damper through width the support rod slides.

As the drum is inclined, it is advantageous to provide a shroud between the inclined open mouth of the drum and the vertical front opening of the cabinet. It is preferred that this shroud is substantially rigid. This is advantageous as it ensures that items cannot accidentally pass around the outside of the drum and into the cabinet, and is also of particular advantage where a removable basket is to be passed into the drum, since the rigid shroud helps support the basket as it is inserted or removed. The rigid shroud is made possible due to the twin suspension system which minimises the movement of the drum within the cabinet.

The first and second suspension units may be connected directly to a fixed water tank within which the drum is rotatably mounted. However, it is preferred that a single rotatable tank is provided which acts as both the water tank and rotatable drum, and therefore, in use, contains both the water for washing and the items to be washed. In this case, it is preferred that the rotatable drum is mounted on a chassis, and that the suspension units are connected between the cabinet of the washing machine and the chassis.

The second suspension unit may be in the form of a tension spring provided between the front of the water tank or chassis supporting the water tank and the front of the cabinet, however it is preferred that the second suspension unit is in the form of a rear thrust bearing. This is of particular advantage where a single drum forms the water tank and holds the items to be washed. In this case, the thrust bearing is preferably formed from two low friction plates, one of which is provided on the rear of the drum or chassis supporting the water tank on drum, and the other on the cabinet of the washing machine. It is advantageous for one or both of the plates to be biased, for example by a spring towards the other plate.

it is advantageous for the second suspension unit to be provided at the back of the drum as the centre of gravity of the drum, especially when this containing water and items to be washed, it towards the back of the drum. During rotation of the drum, the drum will tend to yaw about its centre of gravity, and therefore there will be more movement of the drum further from the centre of gravity then close to the centre of gravity. Therefore, it is advantageous to have the suspension unit as close to the centre of gravity as possible as there will be minimum movement between the drum and the cabinet at this point.

Preferably, the drum is mounted to rotate about an axis inclined at about 20° to 30° to the horizontal.

BRIEF DESCRIPTION OF THE DRAWINGS

An example of the present invention will now be described with respect to the accompanying drawings, in which.

DETAILED DESCRIPTION OF A PREFERRED EXAMPLE

Figure 1:
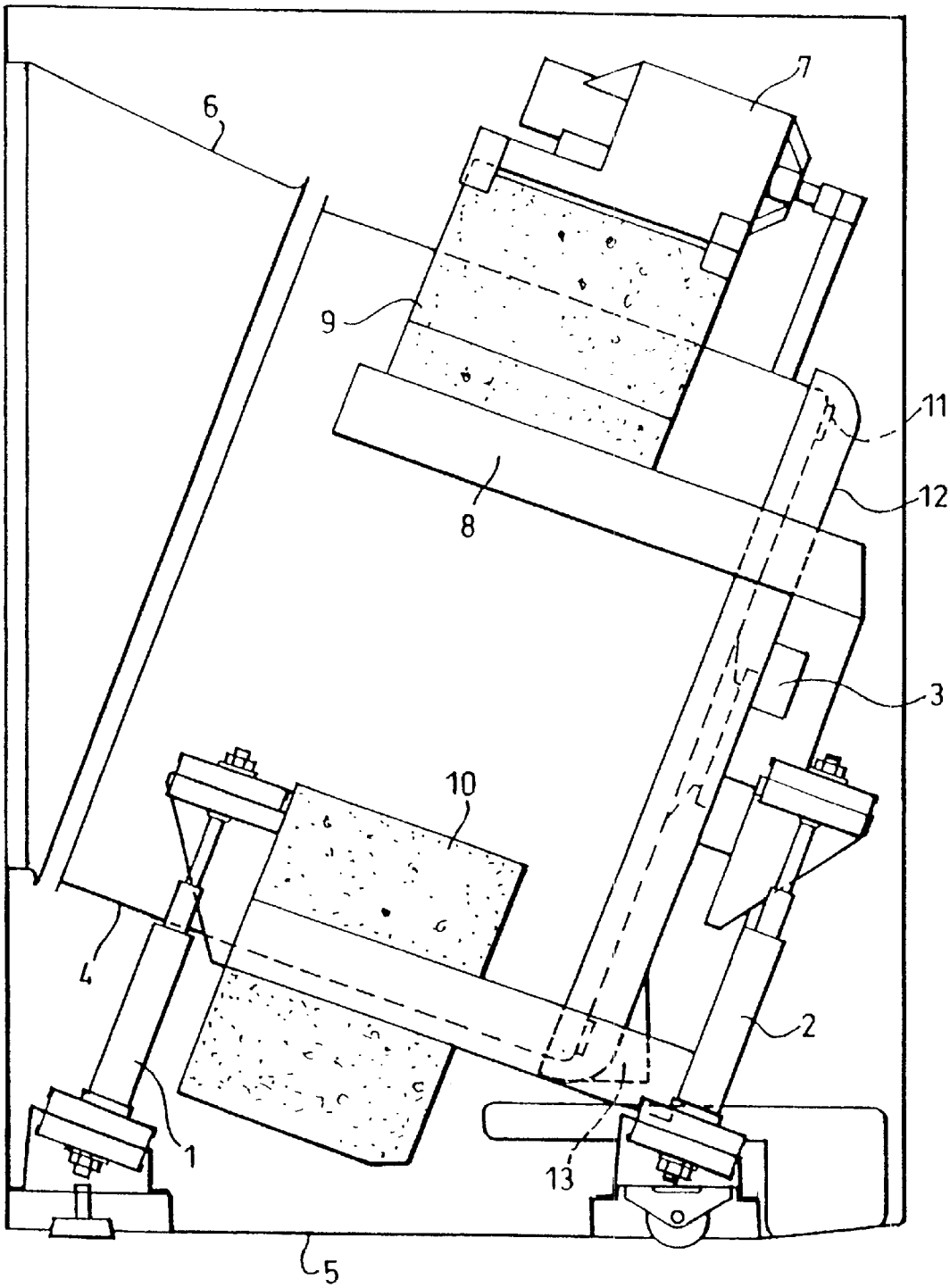
FIG. 1 shows a cross-sectional view through a washing machine including the suspension system of the present invention.

The washing machine shown in the FIG. 1 is provided in a cabinet 5, and includes a single rotatable drum 4 which is mounted with its axis of rotation at an angle of approximately 200 to the horizontal. The drum 4 has solid side walls enabling it to contain both items to be washed and the water for washing. The water is introduced into the drum 4 through the spindle about which the drum 4 rotates, and is expelled from the drum 4 through holes 11 provided in the back end of the drum below the lowest point of the open front end of the drum 4, and into a water collector 12 which directs the collected water through an outlet 13.

The front of the cabinet 5 includes an opening through which the user has access to the inside of the drum 4. A generally rigid shroud 6 is provided between the vertical front opening of the cabinet and the front opening of the drum 4. The shroud 6 extends close to the open end of the drum 4 so that items being washed are unable to pass out of the drum 4 and into the cabinet 5.

The drum 4 is rotatably mounted on a chassis 6. The chassis 8 includes ballast weights 9, 10 to help damp vibrations which may occur as the drum 4 is rotated, especially during high speed rotation. A motor 7 is provided to rotate the drum 4 as required.

The chassis 8 is supported by a first suspension unit including four independent sprung damper suspension units 1,2. Only two of these units are shown in FIG. 1, however it will be appreciated that another two units are provided behind those which can be seen.

Figure 2:
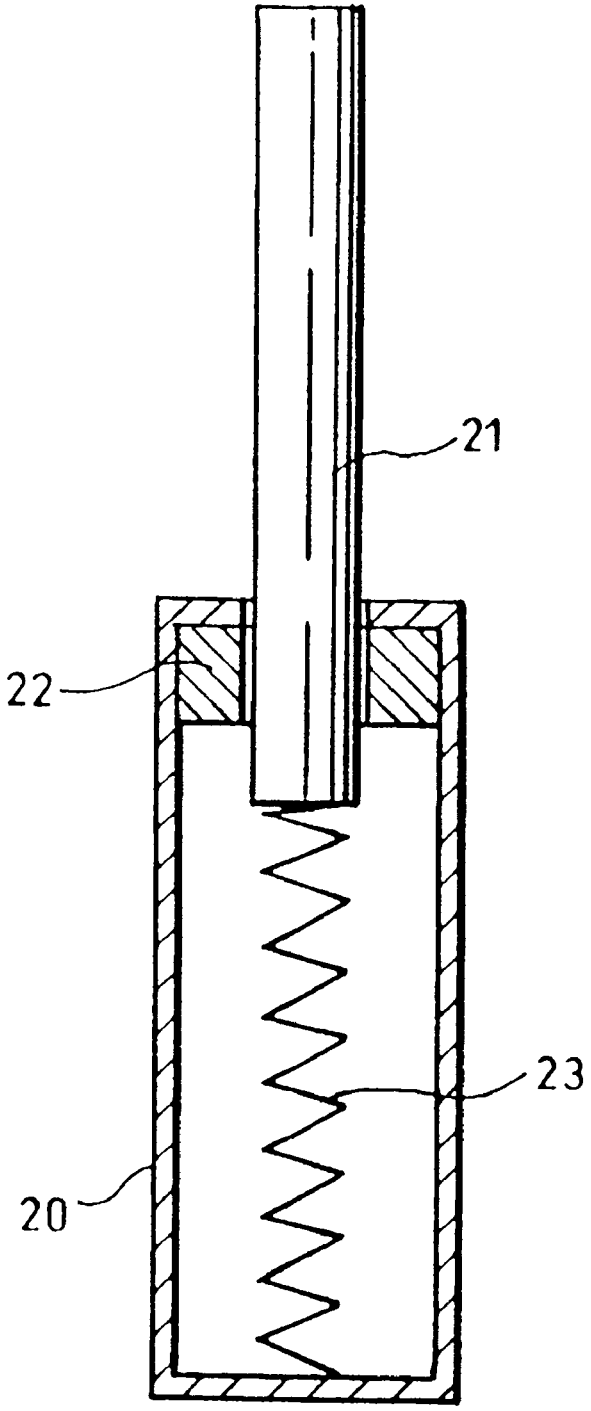
FIG. 2 shows a cross-section through the first suspension unit shown in FIG. 1.

The sprung damper units 1, 2 are best seen in FIG. 2. The unit comprises a hollow cylindrical body portion 20, at the top of which is provided an annular damper 22. A rod 21 is slidably provided in the hollow body portion 20, and is biased by a spring 23 away from the bottom of the body portion 20. The rod 21 slides through the annular damper 22 of the suspension unit. Any attempt to slide the rod 21 into the hollow body will be resisted by the spring 23, thereby giving the required damping effect.

As shown in FIG. 1, each of the body portions 20 of the sprung damper units is connected to the base of the cabinet 5 using rubber washers, and the free ends of the each of the rods 21 are connected to the chassis 8, again using rubber washers. With this arrangement, any forces normal to the axis of rotation of the drum 4 will be damped by the spring damper units 1,2 of the first suspension unit.

These suspension units may be replaced by any other linear suspension, namely a unit which is able to resist generally axial forces.

In addition, a rear thrust bearing comprising a pair of low friction plates 3 is provided between the rotatable drum 4 and the back of the cabinet 5. One of the plates is spring biased towards the other plate, and therefore gives a compensating force component parallel to the axis of rotation of the drum 4. This compensating force opposes the component of the static force parallel to the axis of rotation of the drum 4, and thereby prevents the bending or twisting of the spring damper units 1, 2, and forward and backwards movement of the drum 4. This allows the shroud 6 to be rigid, with only a small gap between the drum 4 and shroud 6, and between the drum 4, chassis 9 and cabinet 5. This in turn allows the size of the drum 4 to be maximised yet still fit within a standard size cabinet.

What is claimed is:

1. A washing machine comprising a base, a drum mounted above the base for rotation about an inclined axis, the drum having a center of gravity and an axis of rotation, a first, linear, suspension unit inclined at an angle substantially normal to the axis of rotation of the drum, and a second suspension unit provided generally parallel to the axis of rotation of the drum, wherein the first, linear, suspension unit comprises a body portion which slidably supports a rod which is biased away from the body.

2. The washing machine of claim 1, wherein the first suspension unit includes an annular damper through which the support rod slides.

3. A washing machine according to any one of claims 1–2, further including a cabinet and wherein the drum includes an inclined open mouth and wherein a shroud is provided between the inclined open mouth of the drum and a vertical front opening of the cabinet of the washing machine.

4. The washing machine of claim 3, wherein the shroud is substantially rigid.

5. The washing machine of any one of the claims 1–2, wherein the drum is rotatably mounted within a fixed water tank and the first and second suspension units are connected directly to the fixed water tank.

6. The washing machine of any one of the claims 1–2, wherein the drum comprises a single rotatable tank which also acts as a water tank, the tank being configured to contain water for washing and items to be washed.

7. The washing machine of claim 6, further including a cabinet, wherein the rotatable drum is mounted on a chassis, and wherein the first and second suspension units are connected between the cabinet of the washing machine and the chassis.

8. The washing machine of any one of the preceding claim 1–2, further including a cabinet, wherein the second suspension unit comprises a tension spring provided between a front of the drum and a front of the cabinet.

9. The washing machine of any one of claims 1–2, wherein the second suspension unit comprises a rear thrust bearing.

10. The washing machine of claim 8, further including a cabinet, wherein the rear thrust bearing comprises two low friction plates, one of which is provided on a rear of the drum, and the other is provided on the cabinet of the washing machine.

11. The washing machine of claim 10, wherein one of the plates is biased towards the other plate.

12. The washing machine of claim 11, wherein the one of the plates biased towards the other plate is biased by a spring.

13. The washing machine of claim 9, further including a cabinet wherein the rotatable drum is mounted on a chassis, and wherein the rear thrust bearing comprises two low friction plates, one of which is provided on a rear of the chassis, and the other is provided on the cabinet of the washing machine.

14. The washing machine of any one of claims 1–2, wherein the second suspension unit is provided proximate to the center of gravity of the drum.

15. The washing machine of any one of claims 1–2, wherein the drum is mounted for rotation about an axis inclined at about 20° to 30° from a horizontal plane.

16. The washing machine of any one of the preceding claims 1–2, further including a cabinet, wherein the drum is mounted on a chassis, and wherein the second suspension unit comprises a tension spring provided between a front of the chassis and a front of the cabinet.

* * * * *